United States Patent [19]

Tremblay

[11] 4,449,346

[45] May 22, 1984

[54] PANEL ASSEMBLY

[76] Inventor: J. Gerard Tremblay, 8361 Place Fonteneau, Montreal, Quebec, Canada, H1K 4S2

[21] Appl. No.: 206,150

[22] Filed: Nov. 12, 1980

[51] Int. Cl.[3] ..... E04B 1/38; E04C 1/40

[52] U.S. Cl. ..... 52/509; 52/512; 52/471; 52/586

[58] Field of Search ..... 52/509, 512, 586, 471, 52/468, 466, 460

[56] References Cited

U.S. PATENT DOCUMENTS

| | | | |
|---|---|---|---|
| 152,892 | 7/1874 | Anthony | 52/471 |
| 549,905 | 11/1895 | Parham | 52/471 |
| 747,120 | 12/1903 | Beaumont | 52/471 |
| 2,115,270 | 4/1938 | Leash | 52/471 |
| 2,186,511 | 1/1940 | Welch | 52/471 |
| 2,373,808 | 4/1945 | Brown | 52/471 |
| 2,388,297 | 11/1945 | Slaughter . | |
| 2,956,652 | 10/1960 | Liskey | 52/512 |
| 2,962,133 | 11/1960 | Kivett | 52/468 |
| 3,341,999 | 9/1967 | Berg | 52/471 |
| 3,731,445 | 5/1973 | Hoffmann | 52/471 |

FOREIGN PATENT DOCUMENTS 1049736 3/1979 Canada .

*Primary Examiner*—Henry E. Raduazo

*Attorney, Agent, or Firm*—Swabey, Mitchell, Houle, Marcoux & Sher

[57] ABSTRACT

The invention is concerned with a panel assembly including at least two panels and a connector member for mounting the panels to a support surface, the panels being positioned edge-to-edge in coplanar relationship with the respective confronting edges thereof spaced apart, and the connector member between the confronting panel edges and interlocking the panels together by being fixedly secured to the support surface. Each panel has first and second surfaces lying respectively in first and second parallel planes and has on its respective confronting edge a tongue and a groove, the tongue and groove extending along the panel edge and between the first and second planes, and respectively projecting and opening outwardly angularly towards the first plane. The connector member comprises an elongated body filling the space between the confronting panel edges and having on each side thereof a tongue and a groove respectively projecting and opening outwardly angularly towards the second plane; the tongue and groove on either side are complementary to and lockingly engage with the respective groove and tongue on the adjacent respective confronting edges of the panels. The connector member cooperates with the panels to urge the panels towards one another in tight locking engagement as a result of a compressive force being exerted on the member in a direction towards the support surface when the member is secured to the support surface. The provision of such connector member does away with the hitherto practice of driving nails or screws in the panel edges to fix the panels to the support surface, while still providing a tight locking engagement between the panels.

15 Claims, 2 Drawing Figures

PANEL ASSEMBLY

BACKGROUND OF THE INVENTION

1. Field of the Invention

This invention relates to a panel assembly including at least two panels and a connector member for mounting the panels to a support surface. More particularly, the invention is concerned with a panel assembly in which the panels are positioned edge-to-edge in coplanar relationship with the respective confronting edges thereof spaced apart, and the connector member is inserted between the confronting panel edges and interlocks the panels together upon being fixedly secured to the support surface. The invention is also directed to the connector member for use in mounting the panels to the support surface, as well as to a method of assembling the panels together utilizing this connector member.

2. Description of Prior Art

Applicant has already described in his Canadian Pat. No. 1,049,736 of Mar. 26, 1979 a panel assembly featuring interlocking panels juxtaposed edge-to-edge in coplanar relationship and having on the respective confronting edges thereof a tongue and groove arrangement. The tongue and groove on the confronting edge of one panel are downwardly inclined and lockingly engaged with the respective groove and tongue on the confronting edge of the adjacent panel, which are upwardly inclined and complementary to the downwardly inclined tongue and groove. Before assembling the panels by juxtaposing them edge-to-edge so as to cause the panels to laterally interlock through their respective tongues and grooves, it is necessary however to fix one panel to a support surface, such as a sub-floor, by driving one or more nails or screws into the panel edge through its upwardly inclined groove; the other panel after being juxtaposed is similarly fixed to the sub-floor. Applicant has found through experience that the application of such interlocking panels as flooring, although advantageous, is restricted by the fact that portions of the adjacent tongue can be chipped or broken off by inaccurate hammering. The fact that the nails or screws must be driven into the panel edge at an angle towards the panel, increases the difficulties of joining the panels particularly since the panels should be urged towards each other to ensure a tight joint.

In addition, when the panel assembly of the above type comprises a combination of two end panels and one or more central panels interposed between the end panels and such panels are to be completely covered by a wear-resistant coating with an anti-skid surface defined in the top coating of each panel, it is necessary to employ three molds for injecting the coating material over the panels. A first mold is utilized for one end panel having a flat edge and a downwardly inclined tongue and groove arrangement on the opposite edge, a second mold for the central panels having on one edge an upwardly inclined tongue and groove arrangement and on the opposite edge a downwardly inclined tongue and groove arrangement, and finally a third mold for the other end panel having a flat edge and an upwardly inclined tongue and groove arrangement on the opposite edge. This of course greatly contributes to a high cost production of such coated panels.

It is also known from U.S. Pat. No. 2,338,297 of Nov. 6, 1945 to use a connector member for joining sheet elements at various angles. The connector member proposed in this patent, which may have various designs according to the intended arrangement of the sheet elements, comprises an extruded plastic strip having along each edge thereof flexed side walls defining a groove for receiving a beaded edge of the sheet element also made of plastic, the flexed side walls of the connecting strip exerting a gripping action on the beaded edge received in the groove. Although the natural elasticity of the plastic is sufficient to hold the elements together into substantially rigid structures, it is generally necessary to weld together the plastic material of the walls forming the groove and of the bead by heat or solvent action at the line of contact, in order to provide a secure locking between the elements. Such type of assembly is accordingly time-consuming to effect and cannot be conveniently used particularly for flooring owing to the upper side walls of the connecting strip protruding at the joint over the surfaces of the sheet elements, and detracting from the appearance of the flooring surface.

SUMMARY OF INVENTION

It is therefore an object of this invention to overcome the above-mentioned drawbacks and to provide an improved panel assembly which can be easily and rapidly effected and which does away with the hitherto practice of driving nails or screws in the panel edges to fix the panels to a support surface.

It is another object of the invention to provide a panel assembly which features a secure locking engagement between the panels.

It is yet a further object of the invention to provide a panel assembly which embodies a connector member adapted to cooperate with the panels so as to urge the panels towards one another in a tight locking engagement when the connector member is secured to a support surface.

In accordance with a first aspect of the invention, there is provided a panel assembly including at least two panels and a connector member for mounting the panels to a support surface, the panels being positioned edge-to-edge in coplanar relationship with the respective confronting edges thereof spaced apart, and the connector member between the confronting panel edges and interlocking the panels together by being fixedly secured to the support surfaces. Each panel has first and second surfaces lying respectively in first and second parallel planes and has on its respective confronting edge a tongue and a groove; the tongue and groove extend along the panel edge and between the first and second planes, and respectively projects and opens outwardly angularly towards the first plane. The connector member comprises an elongated body filling the space between the confronting panel edges and having on each side thereof a tongue and a groove respectively projecting and opening outwardly angularly towards the second plane; the tongue and groove on either side are complementary to and lockingly engage with the respective groove and tongue on the adjacent respective confronting edges of the panels. The connector member cooperates with the panels to urge the panels towards one another in tight locking engagement as a result of a compressive force being exerted on the member in a direction towards the support surface when the member is secured to the support surface.

According to another aspect of the invention, there is provided a connector member for use in mounting onto a support surface two panels edge-to-edge in coplanar relationship. The connector member is adapted to be inserted between the confronting panel edges and to interlock the panels together upon being fixedly secured to the support surface, wherein each panel has first and second surfaces lying respectively in first and second parallel planes and having on its respective confronting edge a tongue and a groove, which tongue and groove extend along the panel edge and between the first and second planes, and respectively projects and opens outwardly angularly towards the first plane. The connector member comprises an elongated body having on each side thereof a tongue and a groove respectively projecting and opening outwardly angularly towards the second plane, the tongue and groove on either side being complementary to and adapted to lockingly engage with the respective groove and tongue on the adjacent respective confronting edges of the panels, the connector member being adapted to cooperate with the panels to urge the panels towards one another in tight locking engagement upon application of a compressive force on the member in a direction towards the support surface when the member is secured to the support surface.

According to a further aspect of the invention, there is provided a method of mounting at least two panels onto a support surface to provide a panel assembly, which comprises: positioning onto the support surface the panels edge-to-edge in coplanar relationship with the respective confronting edges thereof spaced apart, each panel having first and second surfaces lying respectively in first and second parallel planes and having on its respective confronting edge a tongue and a groove, the tongue and groove extending along the panel edge and between the first and second plane, and respectively projecting and opening outwardly angularly towards the first plane; inserting between the confronting panel edges a connector member, the connector member comprising an elongated body having on each side thereof a tongue and a groove respectively projecting and opening outwardly angularly towards the second plane, the tongue and groove on either side being complementary to and adapted to lockingly engage with the respective groove and tongue on the adjacent respective confronting edges of the panels; sliding at least one of the panel towards the other panel to thereby cause the tongue and groove on each side of the connector member between the panels to engage with the respective groove and tongue on the respective confronting edges of the panels; and applying a compressive force on the connector member in a direction towards the support surface by fixedly securing the member to the support surface, thereby causing the connector member to cooperate with the panels to urge the panels towards one another in tight locking engagement.

The panel assembly of the invention is particularly suited as flooring for balconies, but it may also serve for wall paneling.

BRIEF DESCRIPTION OF DRAWINGS

Preferred embodiments of the invention will now be described in greater details with reference to the appended drawings, wherein.

DESCRIPTION OF PREFERRED EMBODIMENTS

Figure 1:
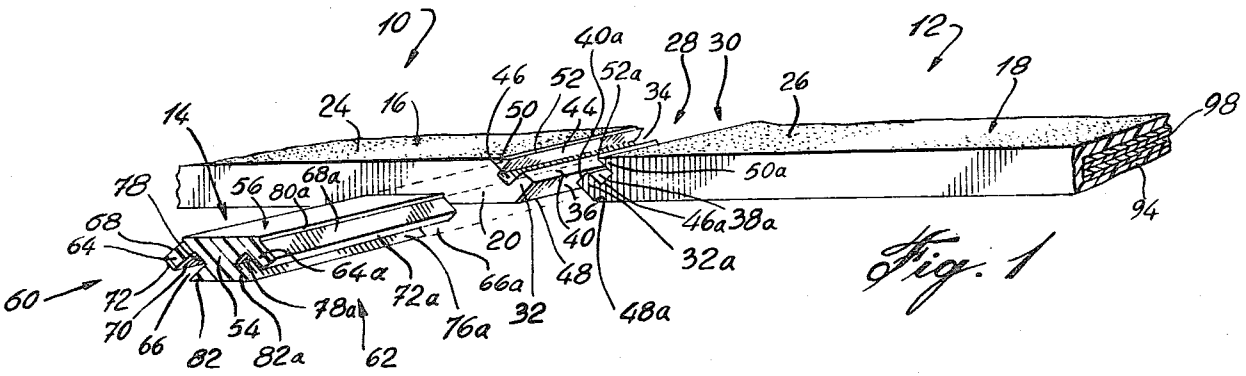
FIG. 1 is an exploded perspective view illustrating the components of a panel assembly, the panels being partly cut away.

Referring first to FIG. 1, the embodiment illustrated is seen to include two floor panels 10 and 12 which are to be joined together by means of a connector member 14.

The panels 10 and 12 have respective top surfaces 16 and 18 and bottom surfaces 20 and 22; the top surfaces 16 and 18 are formed with anti-skid surfaces 24 and 26. The panels 10 and 12 are adapted to be positioned edge-to-edge in coplanar relationship with their respective confronting edges 28 and 30 spaced apart.

Figure 2:
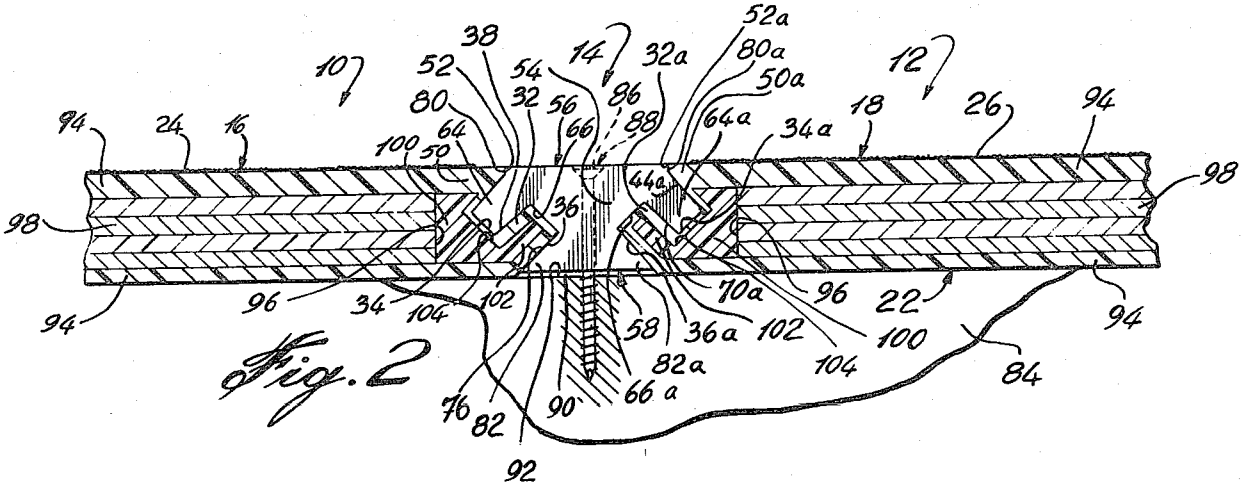
FIG. 2 is a fragmentary vertical partly cross-sectional view showing the panel components in the assembled position.

The floor panel 10 is provided on its edge 28 with a tongue 32 and a groove 34 both having rectangular cross-sections and extending along the edge 28. The tongue 32 and groove 34 respectively projects and opens outwardly upwardly at an angle of about 45° to a horizontal plane through which passes the bottom surface 18. The tongue 32 is formed with parallel outer side walls 36 and 38 and an outer end wall 40. The groove 34 is defined by wall 38 of the tongue 32, parallel wall 44 and an inner bight wall 46. The outer side wall 36 of the tongue 32 extends to intersect the bottom surface 20, to form a bevel edge 48. On the other hand, the inner side wall 44 of the groove 34 extends to intersect the top surface 16 at an acute angle thereto, to form in cross-section a triangular projection 50 having a slightly cut-off tip 52 (as best shown in FIG. 2). The confronting edge 30 of the panel 12 is symmetrical and like numbers with subscript "a" have been applied to the corresponding parts.

The connector member 14 is adapted to be inserted between the confronting panel edges 28 and 30 and comprises an elongated body 54 having top and bottom parallel planar surfaces 56 and 58, and two sides 60 and 62. The connector body is provided on its side 60 with a tongue 64 and a groove 66 both having rectangular cross-sections and respectively projecting and opening outwardly downwardly at the same angle at which the tongue 32 and groove 34 on the panel edge 28 are inclined, namely 45°. The tongue 64 and groove 66 are complementary to and adapted to lockingly engage the groove 34 and tongue 32 respectively. The tongue 64 is formed with parallel side walls 68 and 70 and an outer end wall 72. The groove 66 is defined by the side wall 70 of tongue 64, parallel side wall 76 and an inner bight wall 78. The bevel surface of wall 68 terminates at a slight shoulder 80 adapted to abut against the cut-off tip 52 of the projection 50 on panel edge 28 (as best shown in FIG. 2). On the other hand, the side wall 76 of the groove 66 extends to intersect the bottom surface 58 so as to form in cross-section a triangular projection 82 adapted to provide an extended surface for the side wall 36 of the tongue 32 to be received in groove 66.

The other side 62 of the connector body 54 is symmetrical to the side 60, and like numbers with subscript "a" have thus been assigned to corresponding parts; the tongue **64*a* and groove 66*a* are complementary to and adapted to lockingly engage with respectively the groove 34*a* and tongue 32*a* on the panel edge 30**.

The panel assembly which is shown in FIG. 2 mounted onto the sub-floor 84 is obtained by first positioning onto the sub-floor 84, the panels 10 and 12 edge-to-edge in coplanar relationship with their respective confronting edges 28 and 30 spaced apart. The connector member 14 is then inserted between the confronting panel edges 28 and 30 and either panel 10 or 12 is slid towards the other panel 12 or 10 or both panels 10 and 12 are slid towards each other so as to cause the respective tongues and grooves 64,66 and 64a,66a on the sides 60 and 62 of the connector member 14 to engage with the corresponding grooves and tongues 34,32 and 34a,32a on the respective panel edges 28 and 30. It is also possible to telescope the connector member 14 in connecting engagement with the panels 10 and 12 but this alternative procedure is less preferred. Thereafter, a screw 86 is driven through the connector member 14 perpendicularly to its top surface 56 and into the sub-floor 84, the head 88 of screw 86 being flush with the top surface 56. As a result, a compressive force is exerted by the screw 86 on the connector member 14 in a direction towards the sub-floor 84, which causes the tongues 64 and 64a to be pushed further into the corresponding respective grooves 34 and 34a on the adjacent panel edges 28 and 30 and to cooperate with the latter due to their angularity so as to urge the respective tongues 32 and 32a on the panel edges 28 and 30 further within the corresponding grooves 66 and 66a of the connector body 54, thereby displacing the panels 10 and 12 further towards one another in tight locking engagement.

As shown, the top surface 56 of the connector member 14 is coplanar with the top planar surfaces 16 and 18 of panels 10 and 12, the projections 50 and 50a overlapping respectively the tongues 64 and 64a with the respective cut-off tips 52 and 52a abutting against the respective shoulders 80 and 80a. The bottom surface 58 of the connector member 14 is spaced from its top surface 56 at a distance such as to allow for the formation of a gap 90 between the bottom surface 58 and the top surface 92 of the sub-floor 84. The gap 90 allows the displacement of the connector member 14 towards the sub-floor 84 when the latter is being fixed to the sub-floor 84. The gap 90 also serves to accomodate any accumulations of dirt, debris or other refuse which would otherwise cause a slight but readily visible bulging of the flooring surface at the joint, detracting from its appearance.

A caulking material (not shown) is generally applied before the assembly of the panel components onto the respective outer end walls 40 and 40a of tongues 32 and 32a or onto the respective inner bight walls 78 and 78a of grooves 66 and 66a so as to render the joints between the connector member 14 and the panels 10 and 12 water-proof.

In the embodiment illustrated, the panels 10 and 12 are shown provided with a wear-resistant coating 94 which advantageously comprises a relatively rigid plastic material, such as a polyester resin having a fiber glass fabric material (not shown) embedded therein, which fabric material is generally cross-knitted to impart the desired rigidity. Such coated panel is conveniently obtained by fixedly securing to the flat edge 96 of a panel core 98 made of plywood a plastic insert member 100 which includes an outwardly tapering tongue 100 and a groove 102 and has in cross-section a configuration generally conforming to the desired configuration of the respective confronting edge 28 or 30 of the panel 10 or 12. The panel core 98 with its associated insert member 100 are then completely covered with the fiber glass fabric material and the thus covered panel core and associated insert member are placed in a mold having a matrix including a groove and a tongue adapted to engage respectively with the tongue 102 and groove 104 of the insert member so as to cause the fiber glass fabric material to contour over the groove 102 and within the groove 104. The polyester resin is thereafter injected into the mold under a pressure of about 15 pounds/square inch to provide the desired rigid panel coating 94.

It will be appreciated that only two molds will be necessary for obtaining a coated panel assembly comprising a combination of two end panels and one or more central panels interposed between the end panels. Indeed, since the panels are all provided with an upwardly inclined tongue and groove arrangement at their confronting edges, one mold is utilized for either end panel having a flat edge and an upwardly inclined tongue and groove arrangement on the opposite edge, and another mold for the central panels having an upwardly inclined tongue and groove arrangement on each opposite edge.

As to the connector member 14, it is conveniently produced by extrusion of a relatively soft plastic material, such as a polyvinyl compound. The provision of a connector member 14 made of a relatively softer material compared to the rigid material out of which the panel coating 94 is made allows the tongues and grooves 64,66 and 64a,66a on both sides 60 and 62 of the connector member 14 to engage in a snug fit relation with respectively the corresponding grooves and tongues 34,32 and 34a,32a on the adjacent panel edges 28 and 30, and also to take up any imperfections which may have been produced during the molding of the coating 94 adjacent the grooves and tongues 34,32 and 34a,32a, thereby still providing a tight joint.

Coated panels were manufactured having the following dimensions (width x length x thickness):24″×48″×¾″ and 24″×60″×¾″, with the associated connector members having the following respective dimensions: ⅞″×48″×11/16″ and ⅞″×60″×11/16″.

It is apparent that the respective tongues and grooves 32,34 and 32a,34a on the panel edges 28 and 30 and the corresponding respective grooves and tongues 66,64 and 66a,64a on the sides 60 and 62 of the connector member 14 need not necessarily have all the same shape, such as a rectangular cross-section, nor that they be inclined all at the same angle, such as 45°. Such tongues and grooves can be, for instance, formed rounded and more than one tongue and one groove can be provided on each panel edge 28 or 30 and on the adjacent side 60 or 62 of the connector member. The tongue and groove on a same panel edge may be inclined at different angles, and the tongue and groove on the confronting edge of one panel may be inclined at different angles than the tongue and groove on the confronting edge of the adjacent panel; the same applies to the tongue and groove on either side of the connector member 14.

I claim:

1. A panel assembly including at least two panels and a connector member for mounting the panels to a support surface, said panels being positioned edge-to-edge in coplanar relationship with respective confronting edges thereof spaced apart, said connector member being between said confronting panel edges and interlocking said panels together by being compressively and fixedly secured to said support surface; each panel having first and second surfaces lying respectively in first and second parallel planes and having on its respective confronting edge a tongue and a groove, said tongue and groove having generally parallel projecting surfaces extending along said panel edge and between said first and second planes, and respectively projecting and opening angularly towards said first plane; said connector member comprising an elongated body filling the space between the confronting edges and having on each side thereof a tongue and a groove respectively projecting and opening angularly towards said second plane, said tongue and groove on either side of said connector member being complementary to and lockingly engaging with the respective groove and tongue on the adjacent confronting edges of said panels, said connector member being offset with respect to the second plane of said panels for forming a gap above the support surface and cooperating with said panels to urge said panels towards one another in tight locking engagement as a result of a compressive force being exerted on said connector member in a direction towards said support surface when said connector member is compressingly secured to said support surface.

2. A panel assembly according to claim 1, wherein the tongue and groove on each panel edge and the corresponding groove and tongue on each side of the connector member are inclined at an angle of approximately 45° relative to said first and second planes.

3. A panel assembly according to claim 1, wherein the tongue and groove on each panel edge and the corresponding groove and tongue on each side of the connector member have generally rectangular cross-sections.

4. A panel assembly according to claim 1, wherein the tongues and grooves on both sides of said connector member are respectively symmetrical to each other.

5. A panel assembly according to claim 1, wherein said connector member is formed with first and second planar surfaces, the first surface of said member being coplanar with said first plane and the second surface of said member being spaced from the first plane at a distance forming the gap between said second surface and said support surface, said gap allowing displacement of the member towards said support surface upon application thereof of said compressive force.

6. A panel assembly according to claim 5, wherein the groove on each side of the connector member is adjacent the second surface of said member and each groove inner side wall adjacent said second surface extends to intersect said second surface and forms, in cross-section, a triangular projection providing an extended abutting surface for the respective tongue on the adjacent respective confronting edges of the panels.

7. A panel assembly according to claim 5, wherein the groove on each panel edge is adjacent the first surface of panel and each groove inner side wall adjacent said first surface extends to intersect said first surface and forms, in cross-section, a triangular projection overlapping the corresponding tongue on each side of the connector member.

8. A panel assembly according to claim 1, wherein each panel is coated over its entire periphery with a relatively rigid plastic material and wherein the connector member comprises a relatively softer plastic material so as to allow the tongue and groove on each side of said member to engage in a snug fit relation respectively with the groove and tongue on each adjacent panel edge.

9. A panel assembly according to claim 8, wherein the panel coating comprises a polyester resin having a fiber glass fabric material embedded therein.

10. A panel assembly according to claim 9, wherein the connector member comprises a polyvinyl compound.

11. A panel assembly according to claim 1, including means for fixedly securing said connector member to said support surface on which said panels are mounted, to thereby prevent lateral displacement of said panels and displacement thereof away from said support surface, said securing means simultaneously exerting on said member said compressive force.

12. A panel assembly according to claim 1, including a caulking material between an outer end wall of the tongue on each panel edge and an inner bight wall of the corresponding groove on each side of the connector member.

13. A flooring assembly including at least two floor panels and a connector member for mounting the panels to a sub-floor, said floor panels being positioned edge-to-edge in coplanar relationship with the respective confronting edges thereof spaced apart, and said connector member being between said confronting panel edges and interlocking said panels together by being fixedly secured to said sub-floor; each floor panel having top and bottom surfaces lying respectively in outer and inner parallel planes and having on its respective confronting edge a tongue and a groove both of rectangular cross-section, said rectangular tongue and groove extending along said panel edge and between said outer and inner planes, and respectively projecting and opening upwardly at a same angle to said inner plane; said connector member comprising an elongated body filling the space between the confronting panel edges and having top and bottom planar surfaces and having on each side thereof a tongue and a groove having rectangular cross-sections, and respectively projecting and opening downwardly at an angle corresponding to said same angle, the top surface of said member being coplanar with said outer plane, the rectangular tongue and groove on either side of said member being complementary to and lockingly engaging with the respective rectangular groove and tongue on the adjacent respective confronting edges of said panels; said connector member cooperating with said panels to urge said panels towards one another in tight locking engagement as a result of a compressive force being exerted on said member in a direction towards said sub-floor when said member is secured to said sub-floor, said bottom surface of said connector member being spaced from said sub-floor so as to form a gap therebetween allowing for displacement of said member towards said sub-floor upon application thereon of said compressive force.

14. A panel assembly including at least two panels, a connector member for mounting the panels on a support surface, and means for compressingly engaging said connector member and securing the panel assembly to the support surface, the panels being disposed on said support surface in spaced, edge-to-edge, confronting relationship, the connector member being disposed between said confronting panel edges for interlocking the panels together and securing them to said support surface; each panel having first and second parallel planes and a tongue and groove on the panel edge between said planes, said tongues and grooves respectively projecting and opening toward said first plane; said connector member between said confronting panel edges having on opposite sides thereof a tongue and groove respectively opening toward said second plane, said tongues and grooves on said connector member being complementary to and interconnected with the grooves and tongues on the confronting edges of the panels, said connector member having a first and second surfaces, the second surface of said connector member being spaced from said support surface and forming a gap between said second and support surfaces, the compressive force on said connector member by said means for compressingly engaging said connector member urging it toward said gap and drawing the panels toward each other to form a stressed joint between the interconnected tongues and grooves.

15. The structure as claimed in claim 14 in which said panels comprise floor panels and said support surface is a sub-floor, said means for compressingly engaging said connector member comprising fastener means extending through said connector member and secured to said sub-floor, said tongues and grooves having a rectangular cross-section, the tongues and grooves on the respective panel edges and said connector member sides being at the same angle.

* * * * *